US005953838A

United States Patent [19]

Steenwyk

[11] Patent Number: 5,953,838

[45] Date of Patent: Sep. 21, 1999

[54] CONTROL FOR HYDRAULICALLY OPERATED CONSTRUCTION MACHINE HAVING MULTIPLE TANDEM ARTICULATED MEMBERS

[75] Inventor: Timothy E. Steenwyk, Grand Rapids, Mich.

[73] Assignee: Laser Alignment, Inc., Grand Rapids, Mich.

[21] Appl. No.: 08/903,332

[22] Filed: Jul. 30, 1997

[51] Int. Cl.[6] ..... E02F 5/02

[52] U.S. Cl. ..... 37/348; 701/50; 172/2; 172/4; 414/699; 37/907

[58] Field of Search ..... 37/348, 907, 382; 172/2, 4, 4.5, 7; 414/694, 695.5, 699, 786; 701/50

[56] References Cited

U.S. PATENT DOCUMENTS

| | | |
|---|---|---|
| 3,283,230 | 11/1966 | Davies et al. . |
| 3,636,325 | 1/1972 | Chytil . |
| 3,708,232 | 1/1973 | Walsh . |
| 3,727,332 | 4/1973 | Zimmer . |
| 3,813,171 | 5/1974 | Teach et al. . |
| 3,887,012 | 6/1975 | Scholl et al. . |
| 3,997,071 | 12/1976 | Teach . |
| 4,034,490 | 7/1977 | Teach . |
| 4,050,171 | 9/1977 | Teach . |
| 4,129,224 | 12/1978 | Teach . |
| 4,162,708 | 7/1979 | Johnson . |
| 4,231,700 | 11/1980 | Studebaker . |
| 4,273,196 | 6/1981 | Etsusaki et al. . |
| 4,286,386 | 9/1981 | Long . |
| 4,288,196 | 9/1981 | Sutton, II . |
| 4,377,043 | 3/1983 | Inui et al. . |

(List continued on next page.)

FOREIGN PATENT DOCUMENTS

| | | | |
|---|---|---|---|
| 0512584A2 | 11/1992 | European Pat. Off. . | |
| 4201162 | 7/1992 | Germany | 37/348 |
| 60033940 | 2/1985 | Japan . | |
| 045025 | of 1986 | Japan . | |
| 2232430 | 9/1990 | Japan . | |
| 3-25126 | 2/1991 | Japan | 37/348 |
| 4-27029 | 1/1992 | Japan | 37/348 |
| 2101077 | 1/1983 | United Kingdom . | |

OTHER PUBLICATIONS

Product bulletin entitled "Automatic Excavation Depth Measuring Device," published in the United States by Komatsu, publication date unknown.

Product brochure entitled "Laser–Level–System for Controlling Excavation Depth," published in the United States by Moba Electronics, publication date unknown.

Product brochure entitled "Hitachi Computing Monitor HCM–1,"published in the United States by Hitachi, publication date unknown.

Product brochure entitled "Off to New Frontiers of Performance," published in the United States by O&K, publication date unknown.

*Primary Examiner*—Victor Batson

*Attorney, Agent, or Firm*—Van Dyke, Gardner, Linn & Burkhart, LLP

[57] ABSTRACT

An apparatus and method for controlling a hydraulically operated construction machine having a plurality of tandem articulated members which move in a particular pattern, wherein movement of one of the articulated members is controlled in response to movement of a second one of the articulated members. Anticipated future movement of the second articulated member is determined and the first articulated member is controlled as a function at least of the anticipated future movement of the second articulated member. Anticipated future movement is determined by measuring actual delay between movement of the first and second articulated members. Operation of the articulated members is a function of operation of an actuator and a selectable command level.

29 Claims, 6 Drawing Sheets

U.S. PATENT DOCUMENTS 4,413,684 11/1983 Duncklee .
4,452,078 6/1984 Formanek et al. .
4,491,927 1/1985 Bachmann et al. .
4,514,796 4/1985 Saulters et al. .
4,535,699 8/1985 Bühler .
4,600,997 7/1986 Cain et al. .
4,633,383 12/1986 Omachi et al. .
4,693,598 9/1987 Sehr .
4,698,570 10/1987 Satoh .
4,722,044 1/1988 Heiser et al. .
4,726,682 2/1988 Harms et al. .
4,758,970 7/1988 Keary et al. .
4,771,389 9/1988 Takahashi et al. .
4,805,086 2/1989 Nielsen et al. .
4,829,418 5/1989 Nielsen et al. .
4,866,641 9/1989 Nielsen et al. .
4,884,939 12/1989 Nielsen .
4,888,890 12/1989 Studebaker et al. .
4,910,673 3/1990 Narisawa et al. .
4,947,336 8/1990 Froyd .
5,065,326 11/1991 Sahm .
5,088,020 2/1992 Nishida et al. .
5,257,177 10/1993 Bach et al. .
5,356,259 10/1994 Hanamoto et al. .
5,438,771 8/1995 Sahm et al. .
5,442,868 8/1995 Ahn .
5,446,980 9/1995 Rocke .
5,572,809 11/1996 Steenwyk et al. .
5,671,554 9/1997 Geelhoed ..... 37/348
5,682,311 10/1997 Clark ..... 37/348 X
5,699,247 12/1997 Moriya et al. ..... 37/348 X
5,713,144 2/1998 Haraoka ..... 37/348
5,799,419 9/1998 Seo et al. ..... 37/348
5,854,988 12/1998 Davidson et al. ..... 701/50

CONTROL FOR HYDRAULICALLY OPERATED CONSTRUCTION MACHINE HAVING MULTIPLE TANDEM ARTICULATED MEMBERS

BACKGROUND OF THE INVENTION

This invention relates generally to hydraulically operated machines and, in particular, to such machines having multiple tandem articulated members which move in unison in order to produce a desired movement of one of the members. The invention is particularly adapted for use with hydraulically controlled construction equipment, such as hydraulic excavators.

In construction equipment, such as hydraulically operated excavators, one form of control is to provide the operator with manual control of one member such that the member moves in a manner desired by the operator, with other members of the construction equipment automatically controlled, such as by a computer control, in a manner which compensates for the movement of the member manually controlled by the operator. For example, in an excavator having a boom pivotally mounted to a base member, such as an operator's cab, an arm pivotally mounted to the distal end of the boom and a digging bucket pivotally mounted to a distal end of the arm, it is known to provide manual control of the arm and bucket with a control responding to movement of the arm and bucket in order to control movement of the boom in a manner which creates the movement desired by the operator. For example, it is typically desired to excavate on a plane in order to excavate a foundation, pipe trench, or the like. This is accomplished by automatically controlling movement of the boom in a manner which counteracts the variation from a plane which occurs in the movement of the arm and the bucket.

With existing control systems, it is possible for the operator to move the actuator, or joystick, controlling movement of the arm in a manner which creates motion in the arm which is beyond the ability of the control to counteract in controlling the boom. The result is that the excavator excavates in a manner which departs significantly from a plane. In particular, the tendency of the control is to excavate a dip at the start of excavation which is so significantly below the plane of the dig that an unacceptable result is achieved. This result is exaggerated when the arm and bucket are fully, or nearly fully, extended from the base at the beginning of a dig. If the operator fully, or nearly fully, activates the joystick, a velocity is created in the arm and the bucket which cannot be adequately compensated for by the boom under automatic control because the boom's hydraulic valve is incapable of delivering the required hydraulic flow to perform the required counteracting motion. The result of this inadequate boom-countering motion is a further tendency to dig into the ground too deeply initially thereby producing the dip previously discussed.

In U.S. Pat. No. 5,572,809 issued to Timothy E. Steenwyk et al., which is commonly assigned with the present application, a control is provided which compensates for delays accompanying the response of the hydraulic system to commands made upon the system which makes it difficult for the control system to respond in a manner which accurately maintains the cutting edge of the bucket at the desired depth under all conditions. A solution is proposed therein wherein the actuator, or joystick, is monitored in order to provide an input to the control in order to determine anticipated future movement of the arm and thereby compensate for delay between actuation of the arm and counteracting control of the boom. However, it is possible for the operator to actuate the joystick in a manner which exceeds the ability of the control system to compensate with the boom for the resulting actions of the arm.

SUMMARY OF THE INVENTION

The present invention provides an apparatus and method for controlling a hydraulically operated construction machine having a plurality of tandem articulated members which move in a particular pattern wherein movement of one of the members is controlled in response to movement of a second one of the members. According to a first aspect of the invention, anticipated future movement of the second member is determined and the first member is controlled as a function at least of the anticipated future movement of the second member. According to this aspect of the invention, the anticipated future movement is determined by measuring actual time delay between movement of the first and second members. This allows the amount of compensation provided for delays to be precise. Preferably, the actual time delay is measured at the beginning of each start from rest operation of both the manually operated member and the automatically operated member and is utilized at each successive operation of the members.

According to another aspect of the invention, an operator-controlled actuator, or joystick, is provided which is operable by the user for controlling movement of one of the members. A user input selection of a command level is received by a control. The motion-producing system is operated as a function of the operation of the joystick by the operator and by the value of the command level selected by the user. This allows the operator to select the degree of control afforded the operator. In one extreme of command levels, maximum compensation is provided and the operator is essentially only able to determine the direction of movement of the member. A command level at an opposite end of the range of command levels provides more proportionate control wherein the operator is more in control of the members. This command level would be more appropriate for an experienced operator.

In a preferred embodiment, the joystick produces a signal which may be hydraulic, electric, or the like, and which is proportionate to the amount of actuation thereof. A computer is programmed to adjust the signal as a function of the command code entered by the operator. The controlled member is operated as a function of the adjusted hydraulic speed. An input device may be provided for producing an input to the computer which is proportional to the hydraulic signal. An output device may be provided which is driven by the computer to produce the adjusted hydraulic signal for operating the controlled member. The computer increases the adjusted hydraulic signal at a rate that is a function of the value of the command code entered by the operator.

According to yet an additional aspect of the invention, a control computer is provided that is programmed to control movement of the first one of the members in response to movement of the second one of the members and an operator-controlled actuator is provided which is operable by a user for providing an input to the computer for controlling movement of the second one of said members. The computer limits the rate of movement of the second one of said members below the maximum capability of the second one of said members to move. By limiting the rate of movement of the second member, the ability of the operator to produce movements therein which the control is unable to compensate for is significantly reduced.

These and other objects, advantages and features of this invention will become apparent upon review of the following specification in conjunction with the drawings.

DESCRIPTION OF THE PREFERRED EMBODIMENT

Figure 1:
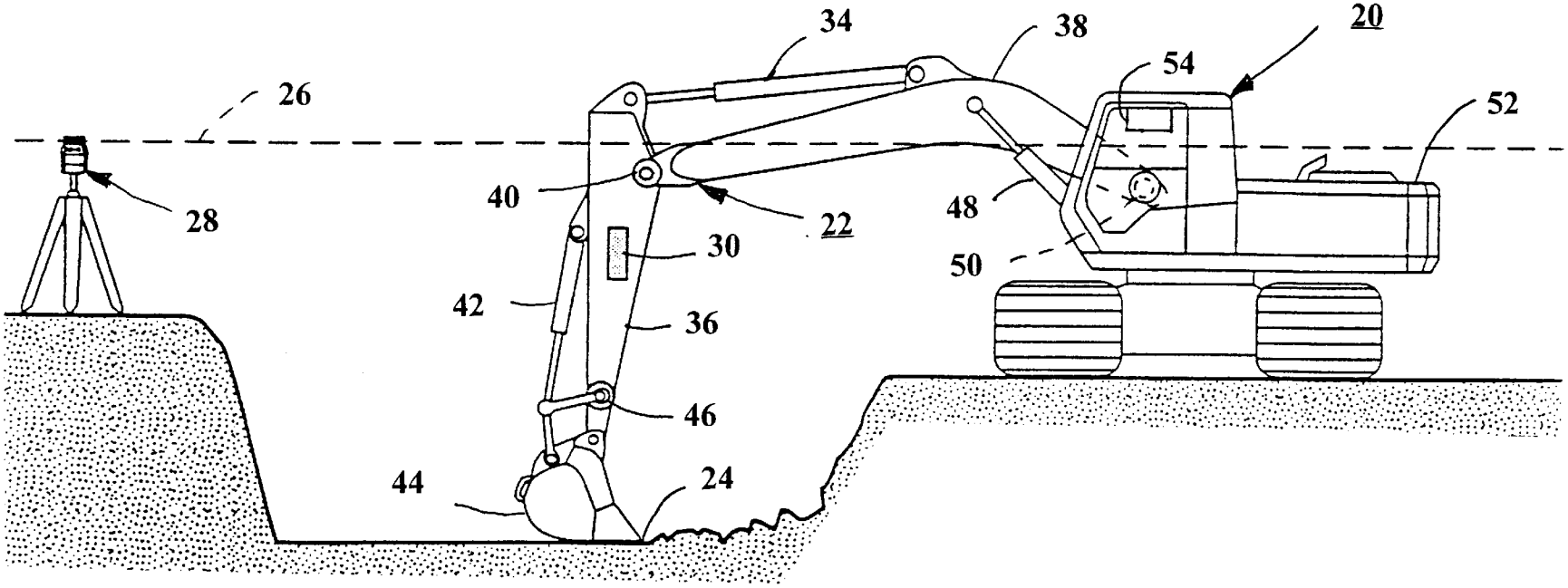
FIG. 1 is a side elevation of a hydraulic excavator controlled according to the invention.

Referring now specifically to the drawings, and the illustrative embodiments depicted therein, U.S. Pat. No. 5,572,809 issued to Timothy E. Steenwyk and Eric J. Walstra for a CONTROL FOR HYDRAULICALLY OPERATED CONSTRUCTION MACHINE HAVING MULTIPLE TANDEM ARTICULATED MEMBERS, the disclosure of which is hereby incorporated herein by reference, discloses a hydraulically operated construction machine having a plurality of tandem articulated members which operate in unison in order to move a portion of one of the members, such as a cutting edge, along a plane that bears a relationship to a reference, such as a light plane. The details of the excavator and its control are set forth in detail in the '809 patent and will not be repeated herein. Suffice it to say, an excavator 20 includes a plurality of tandem articulated members, generally shown in 22, which operate in unison in order to move a portion of one of the members, such as a cutting edge 24, along a plane that bears a relationship to a plane of light 26 generated by a laser beacon 28. Excavator 20 can excavate to either a horizontal plane or a plane on a slope even though plane of light and horizontal position 26 is horizontal. A laser sensor, or receiver 30 mounted to one of the members 22, passes through laser plane 26 occasionally as the operator controls movement of the excavator. Every time the laser sensor passes through laser plane 26, the control system is calibrated in order to establish a true vertical height and horizontal position of cutting edge 24. A control system receives a user selection of a target depth and target slope and controls the movement of one or more of tandem articulated members 22 in order to maintain cutting edge 24 at a desired depth irrespective of movement of the manually controlled members. In particular, the operator controls a manual hydraulic valve (not shown), which regulates the flow of hydraulic fluid to a hydraulic cylinder 34, which controls the position of stick, or arm, 36 with respect to a boom 38. An encoder 40 monitors the relative angular position of arm 36 with respect to boom 38. The operator additionally has a manual control valve (not shown), which operates a cylinder 42, which pivots a bucket 44, with respect to arm 36. A bucket encoder 46 monitors the relative angular position of the bucket with respect to arm 36. The movement of a boom 38 is controlled by a hydraulic cylinder 48, which is under the control of the control system. A boom encoder 50 monitors relative angular position of the boom with respect to cab 52. Encoders 40, 46, and 50 may be rotary encoders operatively connected with the respective members, or may be linear encoders which respond to the extended length of the hydraulic cylinder (34, 42, 48) controlling the respective member, as disclosed in Nielsen et al. '418. In the illustrated embodiment, encoders 40, 46, and 50 are commercially available optical rotary encoders, which are marketed by Hecon Corporation of Germany under Model No. RI41-0/3600 AR.11KB.

In operation, the operator moves the joystick coupled with the manual control valves for cylinders 34 and 42 in order to reposition arm 36 and/or bucket 34. The typical movement is to drag the bucket in a plane in a direction toward the cab 52 in order to excavate with cutting edge 24. The control system responds to its various inputs, including the inputs from encoders 40, 46, and 50, in order to control the flow of hydraulic fluid to cylinder 48 and thereby control movement of boom 38. The control system moves the boom in a manner which maintains the vertical depth of cutting edge 24 at the target depth and on the target slope entered by the operator. Thus, it is seen that arm 36 and bucket 44 are manually controlled members which are moved in response to the operator's joystick and boom 38 is an automatically controlled member whose movement is in response to manual movement of the arm and bucket. It is, of course, possible that boom 38 and bucket 44 be the manually controlled members with arm 36 being automatically controlled. However, such arrangement would be less intuitive to the operator and is, therefore, not preferred.

Figure 2:
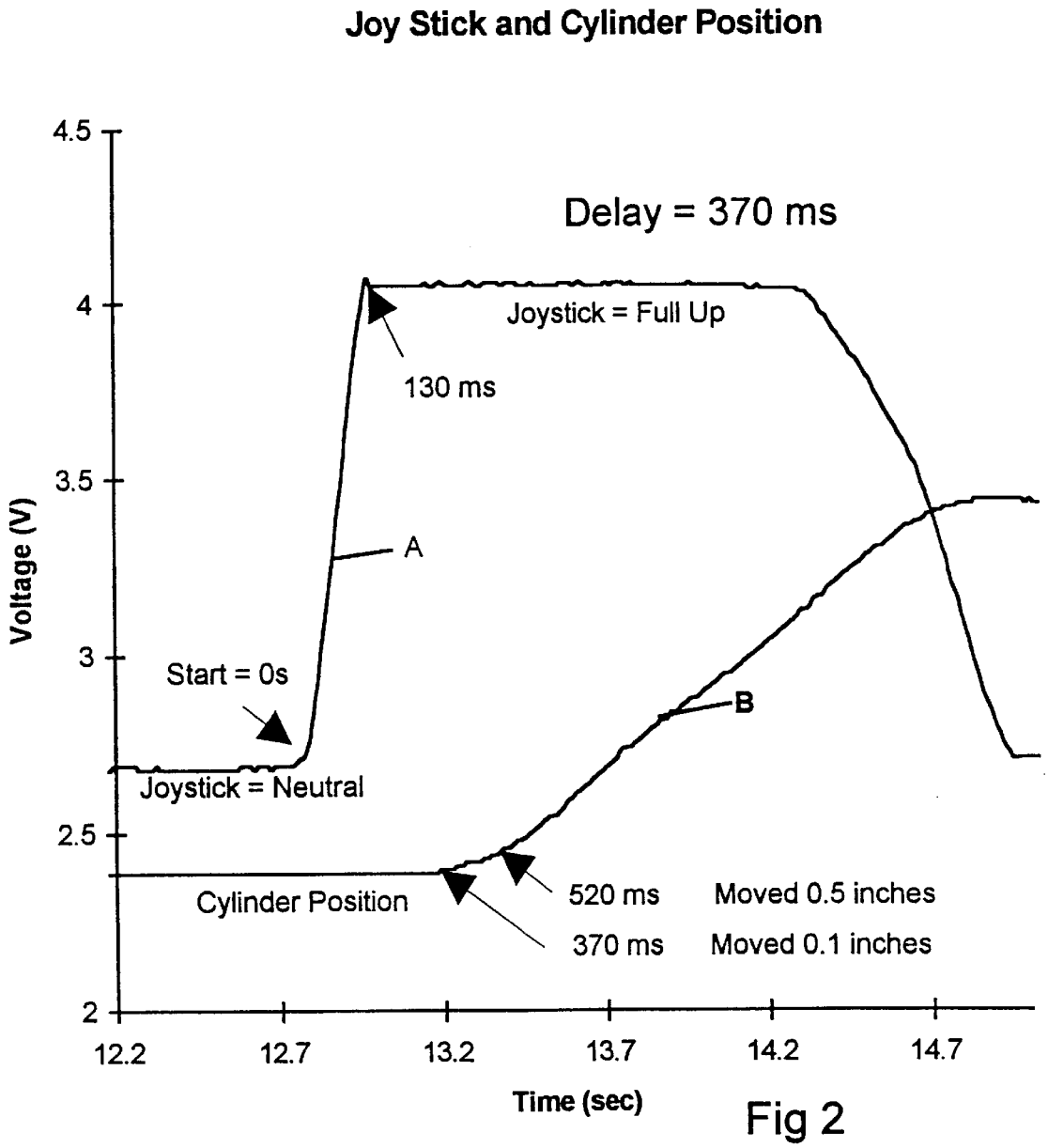
FIG. 2 is a graph illustrating the response of a hydraulically controlled member to movement of the actuator for that member.
Figure 3:
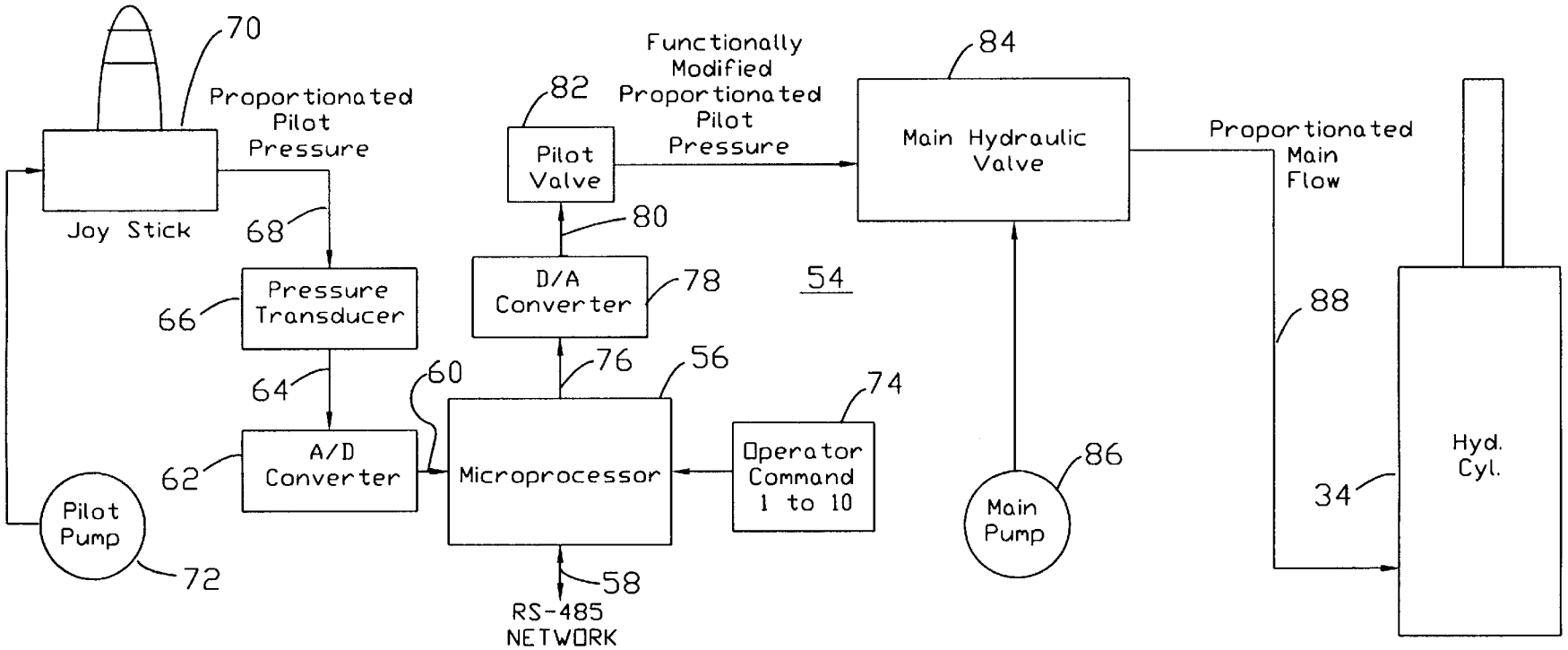
FIG. 3 is a combined hydraulic and electronic control diagram for controlling the arm of the excavator.
Figure 4:
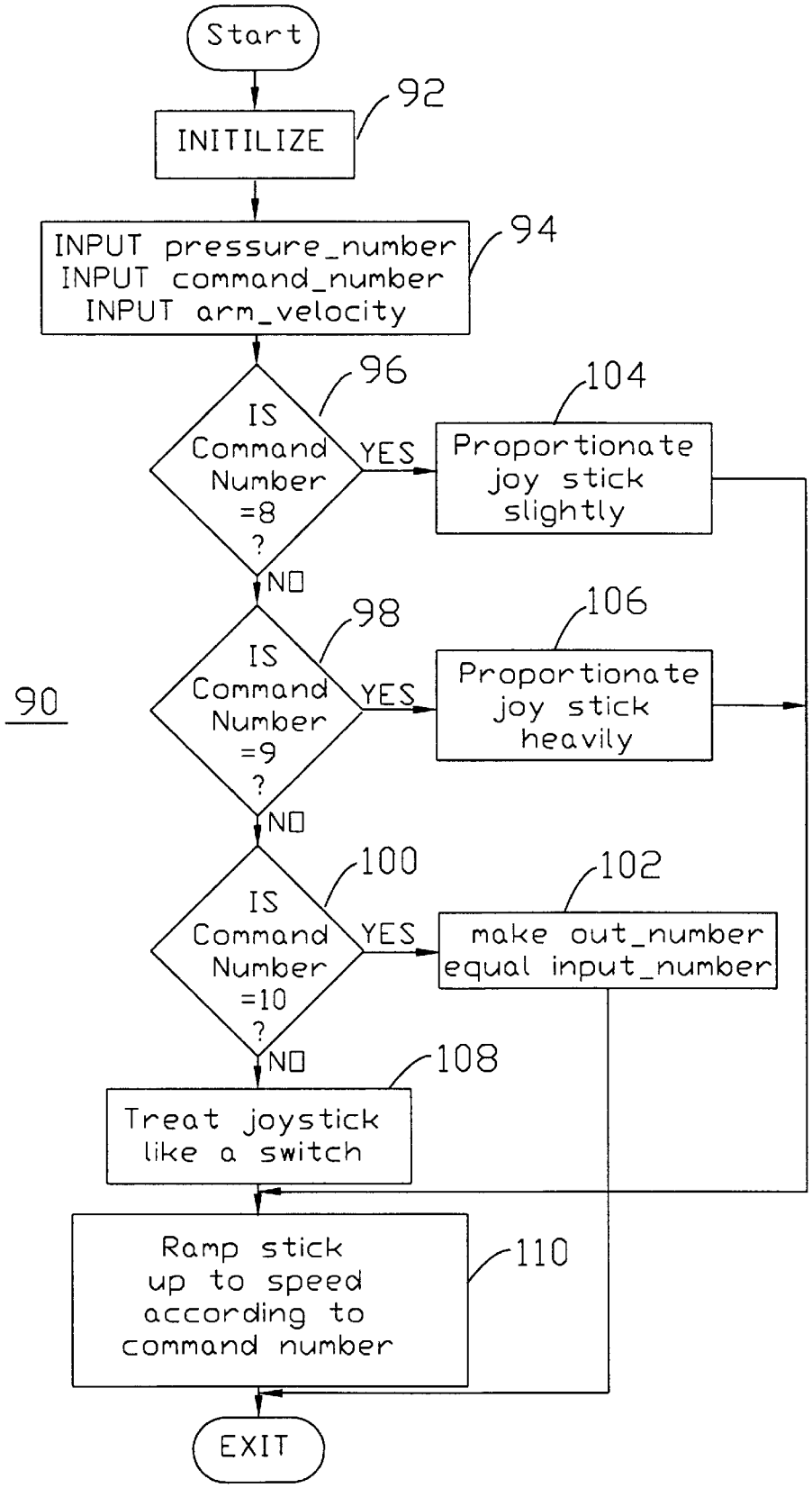
FIG. 4 is a flowchart of a control program for the excavator.
Figure 5:
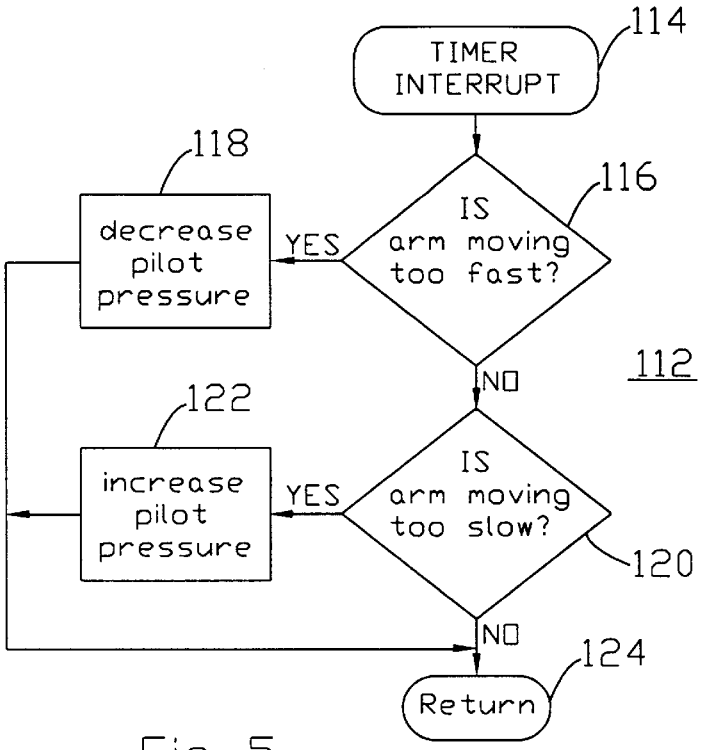
FIG. 5 is a flowchart of an interrupt routine to the program in FIG. 4.

One difficulty with such an excavator control is illustrated by reference to FIG. 2. The signal represented by curve A illustrates the hydraulic pressure supplied to one of members 22, such as arm 36, in response to the operator's movement of the manual actuator, or joystick (not shown), for the arm. It is seen from curve A that movement of the lever causes a rapid increase in the hydraulic pressure supplied to the controlled cylinder (34, 42, 48). Curve B represents the movement of the associated member in response to the input command represented by curve A. A comparison of the signals indicates that there is a delay of a fraction of a second, such as, by way of example, 350 milliseconds, between the operator commanding movement of the member and the actual movement of the member. If the control were to respond to the output of the encoder (40, 46, 50) alone, which would change in proportion to the movement of the associated member as illustrated in curve B, the control signals provided to the cylinder (34, 42, 48) of the controlled member by the control system could lag behind those signals provided to the cylinder (34, 42, 48) of the manually operated member by a significant fraction of a second, or greater. Such delay could create an erratic movement of cutting edge 24. Furthermore, once members 22 are set into motion, the inertia of the members, as well as such delays in the operation of the hydraulic control system, could create instability in the movement of cutting edge 24 as the control system attempts to maintain cutting edge 24 at the desired depth.

Excavator 20 includes a control system 54 having a microprocessor or microcomputer 56 which receives inputs from encoders 40, 46 and 50 and provides an output 58 in order to control operation of boom 38 in a manner disclosed in the '809 patent. Microcomputer 56 additionally includes an input 60 which is supplied with a digital signal from an analog-to-digital (A/D) converter 62. It should be understood that A/D converter 62 may be built into microcomputer 56. A/D converter 62 is provided with an analog electrical signal on a line 64 which is the output of a pressure transducer 66. Pressure transducer 66 converts a pressure signal on a hydraulic line 68 to an electrical signal on line 64 which is proportional to the hydraulic signal at 68. Hydraulic line 68 is, in turn, supplied from an actuator, or joystick 70, which is supplied from a hydraulic pump 72. In this manner, as joystick 70 is actuated by an operator, the movement of the joystick causes a variation in the hydraulic signal at hydraulic line 68 which is converted to an electrical signal by pressure transducer 66 and supplied as an input to microprocessor 56. Microprocessor 56 is additionally supplied with an input from an operator command input device 74. Input device 74 receives a user selection of an operator command code, which, in the illustrated embodiment, is selected in the range of from 1 to 10. Microprocessor 56 modulates the level of the hydraulic signal provided at 68 by the level of the operator command code provided with input 74 in order to provide an output 76 which ultimately controls the operation of hydraulic cylinder 34 in a manner which will be described in more detail below. Output 76, which is a digital signal, is converted to an analog signal by a digital-to-analog (D/A) converter 78 which may be a separate device or an integral part of microcomputer 56. An analog output 80 of D/A converter 78 is provided to a pilot valve 82 which responds thereto by overriding the operation of a main hydraulic control valve 84 in the same manner as disclosed in the '809 patent. Main hydraulic valve 84 is supplied from a hydraulic pump 86 and produces a hydraulic output 88 which operates hydraulic cylinder 34.

Microcomputer 56 includes a control program 90, which, when initialized at 92, receives at 94 a pressured number at input 60 from the amount of actuation, if any, of joystick 70, an input command number from operator command input 74, and an arm velocity input from arm encoder 40. The program then determines at 96 whether the entered command number is equal to 8. If not, it determines at 98 whether the command number is equal to 9. If not, it determines at 100 whether the command number is equal to 10. If the command number is equal to 10, the control provides an output number at output 76 which is equal to the input number provided at input 60 (102). This mode provides a direct logic coupling between the operation of joystick 70 and the hydraulic control signal provided to hydraulic cylinder 34. This provides maximum control to the operator without modification by microprocessor 56. If it is determined at 96 that the command number is equal to 8, the control causes the hydraulic signal being provided to hydraulic cylinder 34 to be slightly responsive to the rate at which the operator operates joystick 70 (104). If it is determined at 98 that the command number is equal to 9, the control causes the hydraulic signal provided to hydraulic cylinder 34 to be heavily influenced by the rate at which the operator operates joystick 70 (106).

Accordingly, for increasing numbers of the operator command value entered at 74, the hydraulic signal provided to the arm hydraulic cylinder is more greatly under the control of the operator. If, in contrast, it is determined (96, 98, 100) that the command number is less than 8, the control treats the joystick like a switch at 108. In this manner, operation of hydraulic cylinder 34 is under the control of microprocessor 56 with the joystick merely providing a switch input to the microprocessor which determines only the direction of movement of the arm. The microcomputer ignores the rate and magnitude of movement of the joystick and merely responds to the direction of motion selected. Accordingly, the control ramps the arm 36 up to speed at a rate which is proportional to the command number entered by input 74 (110). Accordingly, for low values of command number, the rate increase in velocity of the arm is proportional to the command number, with the direction of the arm determined by the movement of joystick 70.

In this manner, a novice operator, who would enter a low command number in input 74, would be unable to cause significant erratic operation of excavator 20 because control of the arm, which is the primary manually operated member, is primarily under the control of the computer. For more experienced operators, the operator command number entered at 74 is increased providing more direct response to commands entered by joystick 70. As the operator command number approaches the highest number, namely 10, the operator is provided essentially full manual control over operation of the arm 36.

An interrupt routine 112 is provided in order to prevent the operator from moving the arm at a rate of speed which cannot be compensated for by movement of the boom in order to avoid dips in excavating which would otherwise be outside of the plane of excavation or other such errors. Interrupt routine 112 is periodically initiated by a timer interrupt at 114 and a determination is made at 116 whether the arm 36 is moving too fast. This is accomplished by monitoring arm encoder 40. If it is determined at 116 that the arm is moving too fast, a decrease in pilot pressure supplied by pilot valve 82 is accomplished by manipulation of output 76 by microcomputer 56 (118). If it is determined at 116 that the arm is not moving too fast, it is then determined at 120 whether the arm is moving too slow. If the arm is moving too slow, microcomputer 56 causes an increase in pilot pressure at 122. If it is determined at 120 that the arm is not moving too slow, then the return is exited at 124 in order to await the next timer interrupt. By controlling the pilot pressure, the control is able to regulate the speed of arm movement. An increase in pilot pressure increases the rate of arm movement and a decrease in pilot pressure decreases the rate of arm movement.

In order to provide a precise amount of compensation in movement of the boom 38 in response to movement of arm 36, a control program 130 includes provisions for measuring actual delay between movement of arm 36 and movement of boom 38 by monitoring encoders 40 and 50. After initialization at 132, program 130 determines at 134 whether the boom 38 and arm 36 are at rest. If it is determined at 134 that the boom and arm are at rest, an arm interrupt and a boom interrupt are enabled at 136. If it is determined at 134 that the boom and arm are not both at rest, then step 136 is bypassed and the interrupts are not enabled. Main control program 90 is then performed. After a pass through control program 90, it is then determined at 138 whether the interrupts are disabled. If the interrupts are disabled, indicating that a measurement of actual delay time has occurred, the parameter "delay-time" is modified as a function of the parameter "measured-time" at 140. If it is determined at 138 that the interrupts are not disabled, then no new measurement of actual delay time has been made and control returns to step 134.

Figure 6A:
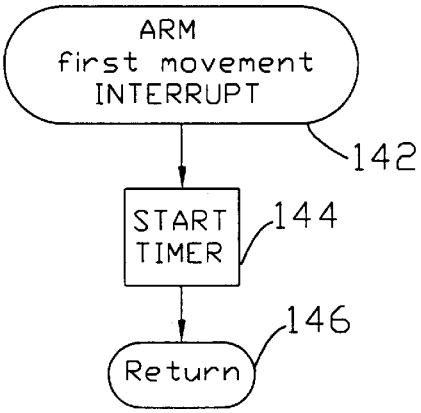
FIGS. 6*a* and 6*b* are flowcharts of an interrupt routine for providing a learning algorithm for the control system.
Figure 6B:
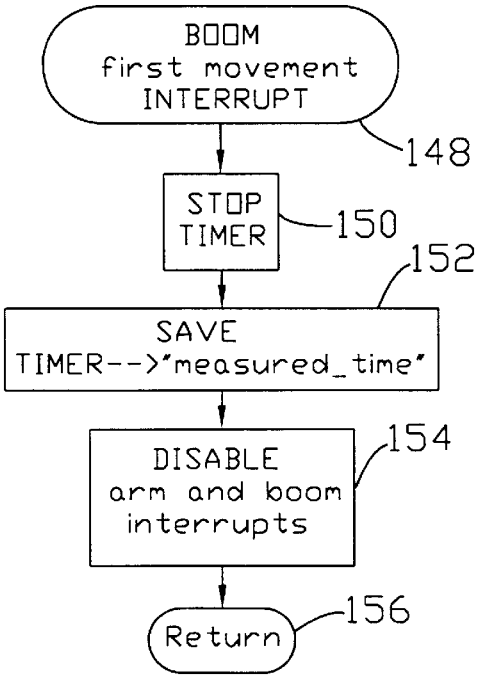
Figure 7:
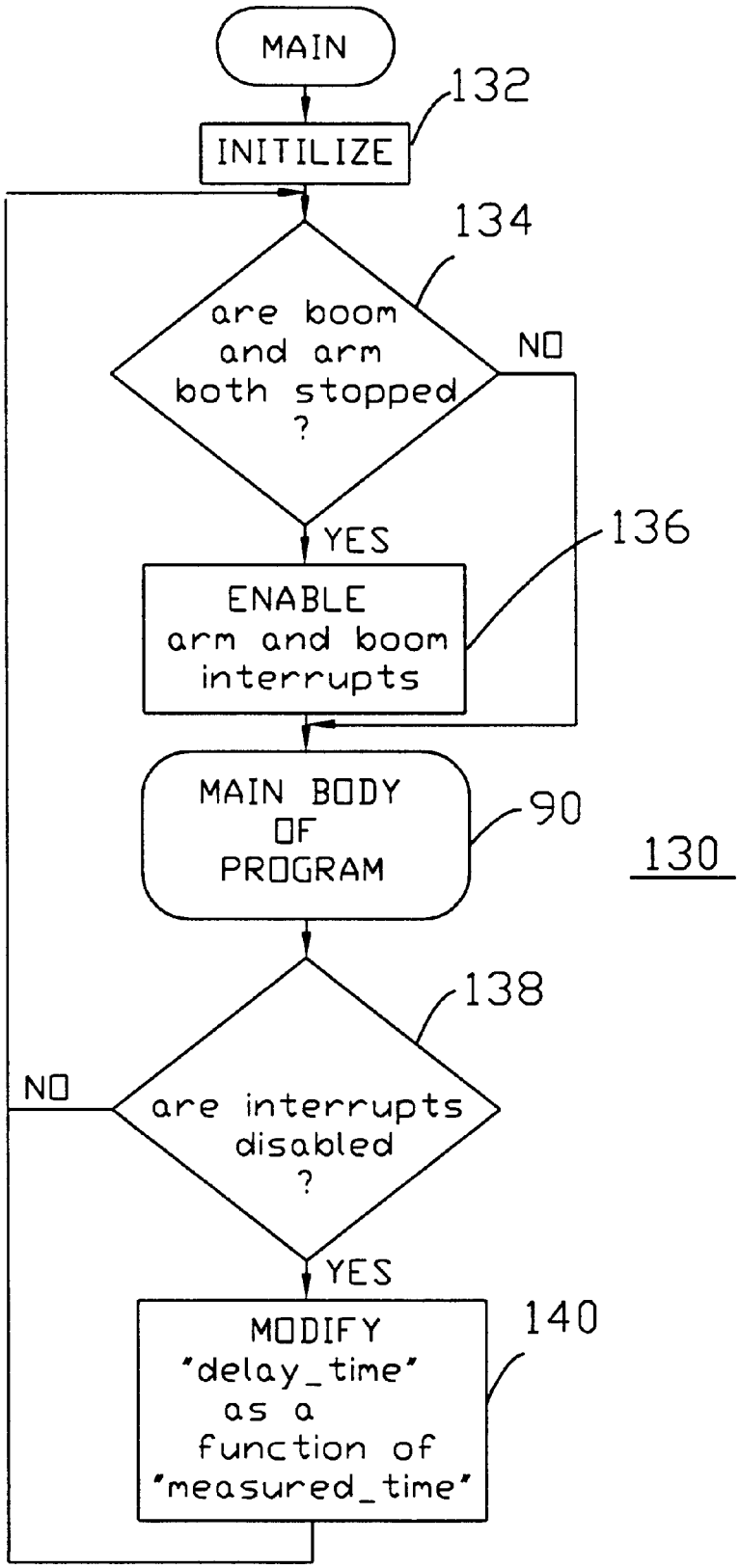
FIG. 7 is a flowchart of the main control program of the excavator.

The manner in which actual measurement of the time delay between movement of arm 36 and boom 38 is accomplished as illustrated in FIGS. 6*a* and 6*b*. If the arm interrupt is enabled at 136, an arm interrupt 142 occurs in response to movement of the arm by monitoring arm encoder 40. Upon receipt of the interrupt, which occurs upon the initial movement of the arm, a timer is initiated at 144 and the program is exited at 146. A boom interrupt 148 will occur upon initial movement of the boom as determined by monitoring boom encoder 50. When the boom interrupt occurs, the timer started at 144 will be stopped at 150 and the value of the time interval measured by the timer will be saved as the "measured-time" parameter at 152. The arm and boom interrupts are then disabled at 154 and the program exited at 156.

The "measured-time" parameter represents the measured actual delay between the movement of the arm and movement of the boom. This parameter is utilized to adaptively modify the value of the "delay-time" parameter which is utilized by the program which controls operation of the boom in a manner disclosed in the '809 patent. Because the value of "delay-time" is a measured parameter rather than an assumed parameter, compensation for delay between operation of the arm and boom may be precisely preformed. This ensures precise compensation or overcompensation while avoiding under compensation. This prevents erroneous operation such as excavation of a dip below the plane, especially during initial excavation without detrimentally inhibiting the speed with which the operator can excavate. Thus, the present invention provides a system which is exceptionally responsive to the operator but precludes the operator from excavating in a manner which produces an unacceptable result.

Changes and modifications in the specifically described embodiments can be carried out without departing from the principles of the invention, which is intended to be limited only by the scope of the appended claims, as interpreted according to the principles of patent law including the Doctrine of Equivalents.

The embodiments of the invention in which an exclusive property or privilege is claimed are defined as follows:

1. A method of controlling a hydraulically operated construction machine having a plurality of tandem articulated members in a manner which moves said tandem articulated members in a particular pattern wherein movement of a first one of said tandem articulated members is controlled in response to movement of a second one of said tandem articulated members, including:

determining anticipated future movement of said second one of said tandem articulated members; and controlling said first one of said tandem articulated members as a function at least of said anticipated future movement of said second one of said tandem articulated members;

wherein said determining anticipated future movement includes measuring actual time delay between movement of said first and second ones of said tandem articulated members.

2. The method of claim 1 including providing encoders on said first and second ones of said tandem articulated members to monitor relative movement between said first one of said tandem articulated members and a reference and between said second one of said tandem articulated members and said first one of said tandem articulated members and wherein said measuring actual time delay includes monitoring said encoders.

3. The method of claim 2 wherein said measuring actual time delay includes determining a time difference between start of movement of one of said first and second ones of said tandem articulated members and start of movement of the other of said first and second ones of said tandem articulated members.

4. The method of claim 3 including measuring actual time delay upon first start from rest operation of both said first and second ones of said tandem articulated members and utilizing the measured time delay during successive start from rest operations of said first one of said tandem articulated members.

5. The method of claim 1 wherein the construction machine includes an actuator operable by a user for controlling movement of said second member and wherein said determining future movement includes monitoring actuation of said actuator.

6. The method of claim 1 including restricting the rate of movement of said second one of said tandem articulated members below a predetermined rate.

7. The method of claim 1 wherein said first one of said tandem articulated members is a boom of an excavator and said second one of said tandem articulated members is an arm of said excavator.

8. A method of controlling a hydraulically operated construction machine having a plurality of tandem articulated members in a manner which moves said members in a particular pattern wherein movement of a first one of said members is controlled in response to movement of a second one of said tandem articulated members, including:

providing an actuator operable by an operator for controlling movement of one of said tandem articulated members;

providing a motion-producing system which moves said one of said tandem articulated members in response to operation of said actuator;

receiving a user input selection of a command level; and operating said motion-producing system as a function of operation of said actuator and a value of said command level selected, wherein said second one of said tandem articulated members is responsive to operation of said actuator in a manner which is determined at least in part by the selected value of said command level.

9. The method of claim 8 wherein said motion-producing system includes a hydraulic cylinder and a hydraulic control valve for supplying hydraulic fluid to said hydraulic cylinder, wherein said operating said motion-producing system includes generating a signal in response to operation of said actuator and modifying said signal as a function of the selected value of said command level.

10. The method of claim 9 wherein said operating said motion-producing system includes limiting the rate of movement of said at least one of said tandem articulated members as a function of the selected value of said command level.

11. The method of claim 9 wherein said signal is a hydraulic signal and wherein said modifying said signal includes converting said hydraulic signal to an electrical input signal, supplying said input signal to a microcomputer, producing an electrical output signal of said microcomputer as a function at least of said input signal and said selected value of said command level, and converting said output signal to an output hydraulic signal and supplying said output hydraulic signal to said hydraulic control valve.

12. The method of claim 8 including restricting the rate of movement of said one of said tandem articulated members below a predetermined rate.

13. A hydraulically operated construction machine having a body, a plurality of tandem articulated members extending from said body, a hydraulic drive system for moving said members with respect to each other subject to a system delay, and a control for said hydraulic drive system which moves said tandem articulated members in a particular pattern, wherein movement of a first one of said tandem articulated members is controlled in response to movement of a second one of said tandem articulated members, comprising:

position encoders on said first and second ones of said tandem articulated members, said position encoders monitoring the positions of said first and second ones of said tandem articulated members; and a control computer that is programmed to control movement of the first one of said tandem articulated members in response to movement of the second one of said tandem articulated members and to determine system delay by monitoring said position encoders to determine differences in first movements of said first and second ones of said tandem articulated members.

14. The hydraulically operated construction machine in claim 13 including an actuator operable by an operator for controlling movement of said second one of said tandem articulated members.

15. A hydraulically operated construction machine having a body, a plurality of tandem articulated members extending from said body, a hydraulic drive system for moving said tandem articulated members with respect to each other up to a maximum speed capacity, and a control for said hydraulic drive system which moves said tandem articulated members in a particular pattern, wherein movement of a first one of said tandem articulated members is controlled in response to movement of a second one of said tandem articulated members, comprising:

a control computer that is programmed to control movement of the first one of said tandem articulated members in response to movement of the second one of said tandem articulated members; and an actuator operable by an operator for providing an input to said computer for controlling movement of said second one of said tandem articulated members, wherein said actuator operates a valve which produces a hydraulic signal proportional to an amount of actuation of the actuator, the computer is programmed to adjust said hydraulic signal as a function of a command code entered by the operator and wherein said second one of said tandem articulated members is operated as a function of said adjusted hydraulic signal, wherein said computer limits the rate of movement of said second one of said tandem articulated members below the maximum speed capability of said second one of said tandem articulated members to move.

16. The hydraulically operated construction machine in claim 15 including an input device for providing an input to said computer which is proportional to said hydraulic signal and an output device which is driven by said computer to produce said adjusted hydraulic signal.

17. The hydraulically operated construction machine in claim 16 wherein said input device comprises a pressure transducer which produces an electronic signal as a function of said hydraulic signal and wherein said output device comprises a pilot valve which produces another hydraulic signal as a function of an output signal produced by said computer.

18. The hydraulically operated construction machine in claim 15 wherein said computer increases said adjusted hydraulic signal at a rate that is a function of the value of said command code entered by the operator.

19. The hydraulically operated construction machine in claim 14 wherein said computer is programmed to limit a speed at which said second one of said tandem articulated members is operated.

20. The hydraulically operated construction machine in claim 13 wherein said first one of said tandem articulated members is an excavator boom pivotally connected with a base unit and wherein said second one of said tandem articulated members is an excavator arm pivotally connected with said boom.

21. The hydraulically operated construction machine in claim 20 including a bucket pivotally connected with said arm and another actuator operable by a user for controlling movement of said bucket.

22. A hydraulically operated construction machine having a body, a plurality of tandem articulated members extending from said body, a hydraulic drive system for moving said tandem articulated members with respect to each other subject to a system delay, and a control for said hydraulic drive system which moves said members in a particular pattern, wherein movement of a first one of said tandem articulated members is controlled in response to movement of a second one of said tandem articulated members, comprising:

position encoders on said first and second ones of said tandem articulated members, said position encoders monitoring positions of said first and second ones of said tandem articulated members; and a control computer that is programmed to control movement of the first one of said tandem articulated members in response to movement of the second one of said tandem articulated members;

an actuator operable by an operator for controlling movement of said second one of said tandem articulated members, wherein said actuator produces a hydraulic signal proportional to an amount of actuation of the actuator, the computer is programmed to adjust said signal as a function of a command code entered by an operator and wherein said second one of said tandem articulated members is operated as a function of said adjusted signal.

23. The hydraulically operated construction machine in claim 22 including an input device for providing an input to said computer which is proportional to actuation of said actuator and an output device which is driven by said computer to produce said adjusted signal.

24. The hydraulically operated construction machine in claim 23 wherein said signal is a hydraulic signal and said input device comprises a pressure transducer which produces an electronic signal as a function of said hydraulic signal and wherein said output device comprises a pilot valve which produces another hydraulic signal as a function of an output signal produced by said computer.

25. The hydraulically operated construction machine in claim 23 wherein said signal is an electrical signal and said output device comprises a pilot valve which produces a hydraulic signal as a function of an output signal produced by said computer.

26. The hydraulically operated construction machine in claim 22 wherein said computer increases said adjusted hydraulic signal at a rate that is a function of the value of said command code entered by the operator.

27. The hydraulically operated construction machine in claim 22 wherein said computer is programmed to limit the speed at which said second one of said members is operated.

28. The hydraulically operated construction machine in claim 22 wherein said first one of said tandem articulated members is an excavator boom pivotally connected with a base unit and wherein said second one of said members is an excavator arm pivotally connected with said boom.

29. The hydraulically operated construction machine in claim 28 including a bucket pivotally connected with said arm and another actuator operable by the operator for controlling movement of said bucket.

* * * * *